United States Patent [19]

Wakabayashi et al.

[11] Patent Number: 4,872,972

[45] Date of Patent: Oct. 10, 1989

[54] APPARATUS FOR CLASSIFYING PARTICLES

[75] Inventors: Minoru Wakabayashi, Hyogo; Hiroyuki Murata; Yasuo Sugino, both of Kobe; Masanobu Yamao, Hyogo; Takao Nishikawa, Kobe, all of Japan

[73] Assignee: Kabushiki Kaisha Kobe Seiko Sho, Kobe, Japan

[21] Appl. No.: 116,964

[22] Filed: Nov. 5, 1987

[30] Foreign Application Priority Data

Nov. 6, 1986 [JP] Japan ..... 61-264790
Nov. 6, 1986 [JP] Japan ..... 61-264791

[51] Int. Cl.[4] ..... B07B 7/04

[52] U.S. Cl. ..... 209/143; 209/146; 209/145

[58] Field of Search ..... 209/133, 134, 135, 136, 209/137, 138, 139.1, 139.2, 143, 146, 145

[56] References Cited

U.S. PATENT DOCUMENTS

| | | | |
|---|---|---|---|
| 2,047,568 | 7/1936 | Lissman | 209/135 |
| 3,311,234 | 3/1967 | Rumpf et al. | 209/139.1 X |
| 3,520,407 | 7/1970 | Rumpf et al. | 209/148 X |
| 4,153,541 | 5/1979 | Rumpf et al. | 209/143 |
| 4,159,942 | 7/1979 | Green et al. | 209/143 |
| 4,657,667 | 4/1987 | Etkin | 209/143 X |

FOREIGN PATENT DOCUMENTS

| | | | |
|---|---|---|---|
| 0246074 | 11/1987 | European Pat. Off. | 209/143 |
| 1244638 | 9/1959 | France | 209/143 |

OTHER PUBLICATIONS

"Application of Fluidics Principle to Fine Particle Classification"—Symposium on Powder Technology.
Catalog entitled "Elbow-Jet".
Catalog entitled "Turbo Classifier".
Catalog entitled "Variable Impactor".
Paper entitled "Highspeed Impact Crushing and Jet Mill".
Paper entitled "Classification of Super Fine Particle".
World Congress Particle Technology, "Trials of Pneumatic Classification in the Neighborhood of Lum" and Size Classification of Industrial Sub-Micron Powder By a Virtual Impactor.

*Primary Examiner*—Kevin P. Shaver
*Assistant Examiner*—David H. Bollinger
*Attorney, Agent, or Firm*—Oblon, Spivak, McClelland, Maier & Neustadt

[57] ABSTRACT

An apparatus for classifying particles entrained by a solid-gas jet stream includes a feed nozzle, a cyclonic wall having an inner arcuate wall, and an auxiliary inner arcuate wall provided at an outlet port of the nozzle. The solid-gas stream is preliminarily bent along the auxiliary inner wall so that the particles are preliminarily or roughly classified into undersized and oversized particles by the action of the centrifugal force before they are classified by the cyclonic wall. The apparatus may include a collecting port disposed downstream of the nozzle outlet port and spaced slightly away from the inner arcuate wall of the cyclonic wall. The collecting port permits the apparatus to collect the undersized particles in a more effective manner.

8 Claims, 10 Drawing Sheets r: RADIUS OF CYCLONIC WALL
B: WIDTH OF OUTLET PORT
θ: TANGENTIAL ANGLE r: RADIUS OF CYCLONIC WALL
B: WIDTH OF OUTLET PORT
θ: TANGENTIAL ANGLE

APPARATUS FOR CLASSIFYING PARTICLES

BACKGROUND OF THE INVENTION

1. Field of the Invention

The present invention relates to an apparatus or classifier for sorting by size particles entrained in a gas-solid stream ejected from a feed nozzle by utilizing the Coanda effect.

2. Description of the Prior Art

There is a known method of and apparatus for sorting particles according to size by passing the feed mixture fluid containing the particles along a cyclonic arcuate surface through a jet stream from a feeding nozzle to impart a centrifugal action to the fluid. This system was reported by Mr. Okuda in the international Symposium Of Particle Technology held in Kyoto in September, 1981. This report discloses test results obtained by the system in which a high speed stream or jet stream of air entraining particles is bent at a small radius of curvature by utilizing the attachment of a stream to an adjacent surface (i.e. the Coanda effect) and imparting a relatively large amount of a centrifugal force to the particles entrained in the stream of the fluid so as to separate the particles by size. A similar method of classification is proposed in U.S. Pat. No. 4,153,541. These methods employ the effect derived from the action of the stream of fluid and the centrifugal force acting on the particles contained in the stream of the fluid, and they are suitable particularly for classification or separation of particles of a small size.

FIG. 13 of the accompanying drawings reillustrates a prior classifier in which a feed nozzle 3 ejects a jet stream of the gas entraining the particles tangentially with respect to an arcuate wall surface 2*a* of a cyclonic wall 2. The stream is attached to the adjacent wall 2*a* by the Coanda effect, and it is thus bent along the arcuate wall 2*a* for thereby forming a curved wall-attachment stream.

This apparatus has a drawback in that the velocity of the wall-attachment stream flowing close to the arcuate surface 2*a* is drastically reduced to zero, with the result that a centrifugal force acts on the particles entrained by the wall-attachment stream insufficiently through the length of the arcuate surface. The thus insufficient action of the centrifugal force on the particles fails to separate the particles sharply into oversized and undersized particles and thus allows the oversized particles to be included in the latter when the processed particles are collected. The prior apparatus achieves only a poor performance of classification.

It is therefore an object of the present invention to provide an apparatus for classifying particles, wherein the oversized particles are reliably separated from the undersized particles in the entraining stream flowing close to the cyclonic arcuate wall surface.

SUMMARY OF THE INVENTION

According to a first aspect for classifying particles into the oversized particles undersized particles comprises: a feed nozzle having an outlet port for producing a jet stream of fluid entraining the particles; cyclonic wall means disposed downstream of and continuous to said outlet port of the nozzle, and having an inner arcuate surface such that the solid-gas stream flows therealong; and said outlet port having an auxiliary inner arcuate surface extending contiguous to said inner arcuate surface of said cyclonic wall means so as to impart a centrifugal force to the solid-gas stream before the stream flows along said inner arcuate surface.

According to a second aspect of the invention, a classifier for classifying particles into oversized particles and undersized particles: a feed nozzle having an outlet port for producing a jet stream of fluid entraining the particles; a cyclonic wall means disposed downstream of and continuous to said outlet port of the nozzle, and having an inner arcuate surface such that the solid-gas stream flows therealong; and a collecting port disposed downstream of the nozzle outlet port and spaced by a predetermined distance away from the inner arcuate surface of the cyclonic wall for collecting the undersized particles.

Many other advantages, features and additional objects of the present invention will become manifest to those versed in the art upon making reference to the detailed description and the accompanying drawings in which preferred embodiments incorporating the principles of the present invention are shown by way of illustrative example wherein like and similar parts are indicated by like and similar numerals in the drawings.

DESCRIPTION OF THE PREFERRED EMBODIMENTS

Figure 1:
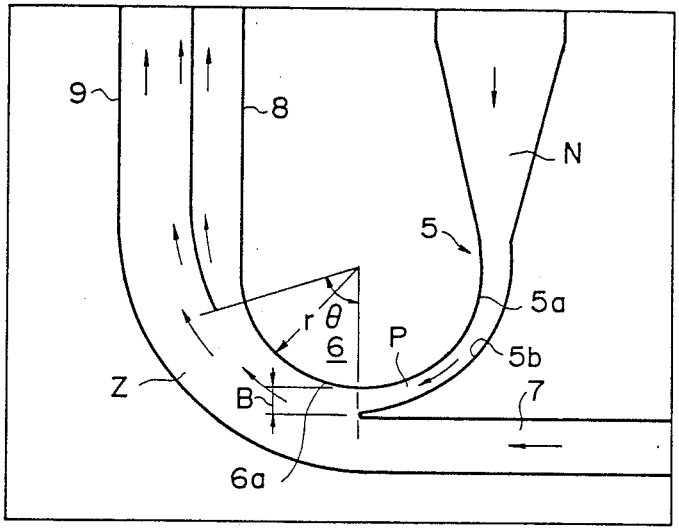
FIG. 1 is a schematic cross-section view of a classifier according to a first embodiment of the present invention.
Figure 2:
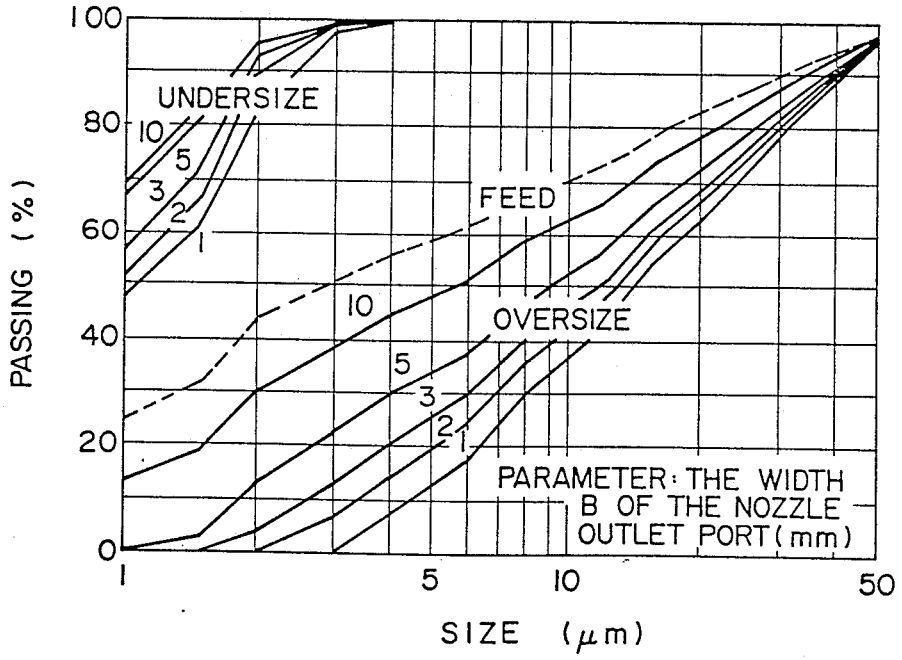
FIGS. 2 and 3 are charts showing the results of a simulation and a test of the classifier, respectively.

FIGS. 1 and 2 show a classifier or an apparatus for classifying particles by size into oversized and undersized particles called sands and slimes, respectively, according to a first aspect of the present invention.

The apparatus includes a feed nozzle N for supplying a jet stream of a solid-gas feed mixture fluid, a cyclonic block 6 disposed downstream of the nozzle N and forming a classifying zone Z therealong, and a control port 7 which tangentially merges with the classifying zone Z for supplying a supplemental jet stream of fluid. The cyclonic block 6 has an arcuate inner wall 6*a* forming the classifying zone Z, where particles in the solid-gas stream are classified into undersized particles called slimes and oversized particles called sands.

The apparatus also includes a pair of adjacent inner and outer exhaust ports 8, 9 extending downstream from the classifying zone Z. The inner and outer exhaust ports 8, 9 collect the limes and sands classified in the upstream zone Z, respectively.

The feed nozzle N has an outlet port 5 including a pair of first and second arcuate side walls 5*a*, 5*b* extending parallel and spaced from each other and defining a curved narrow passage or preliminary classifying zone P therebetween. The arcuate inner wall 6*a* merges smoothly with the first arcuate wall 5*a* of the nozzle outlet port 5.

The jet stream of the solid-gas feed mixture from the nozzle N, consisting of compressed air and the particles in the illustrated embodiment, tends to be attached to the arcuate inner wall 6*a* as the jet stream is injected into the classifying zone Z from the nozzle N. This attachment of the fluid stream to the adjacent wall, known as the Coanda effect, takes place as long as the fluid stream continues to flow at a sufficient speed along the surface. To this end, the stream of the feed mixture from the nozzle outlet port 5 is accelerated by the supplemental stream supplied by the control port 7, and the stream is thereby prevented from being detached from the arcuate inner wall 6*a*.

Figure 4:
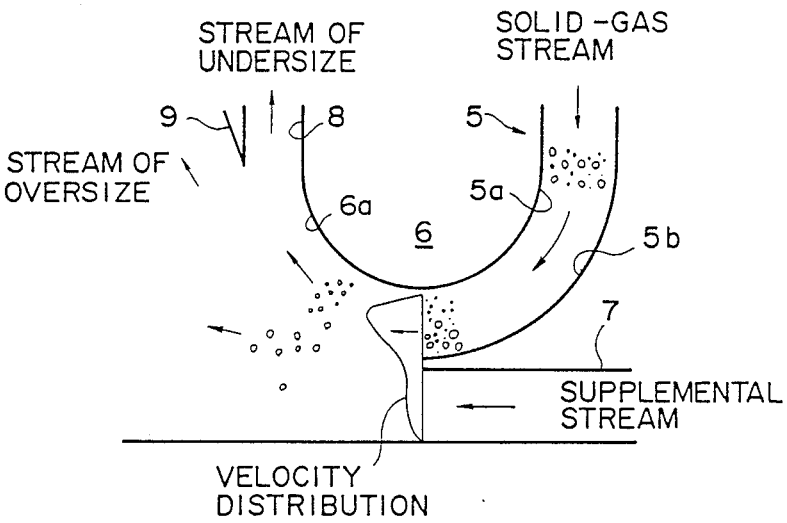
FIG. 4 is an explanatory view showing the distribution of the particles being classified by the classifier.

As best shown in FIG. 4, the feed mixture stream passing through the curved passage P is bent by and between those arcuate walls 5*a*, 5*b*, while the particles entrained by the feed mixture stream are subject to a centrifugal force, with the result that the undersized and oversized particles flock to the inside and outside regions of the passage P, respectively, due to the difference in their mass. However, the particles are classified into oversized and undersized particles only insufficiently or preliminarily in the curved narrow passage P because the feed mixture stream is not yet subject to the Coanda effect. Actually, relatively small sized particles are concentrated at the inside region while the relatively large sized particles are at the outside region of the passage P.

Then the stream of the preliminarily classified feed mixture flows into the classifying zone Z where the stream is accelerated by the supplemental stream from the control port 7 and thus is attached to the arcuate inner wall 6*a* due to the Coanda effect. At this time, the stream is forced to follow the curved path along the inner wall and thus undergoes the centrifugal force, which separates the particles further and reliably into undersized and oversized particles. The inside wall-attachment stream flowing within a layer of air turbulence existing close to the arcuate inner wall 6*a* rarely contains the oversize particles. The solid-gas feed mixture stream entraining the particles thus classified into undersized and oversized particles advances to the exhaust ports 8, 9.

FIG. 2 shows a calculated simulation performance of classification of the apparatus. The classification performance was tested by setting the width B of the nozzle outlet port 5 at 1, 2, 3, 5, and 10 mm with a constant output speed of the feed fluid stream at 250 m/s. As the width B of the nozzle outlet port 5 was narrowed successively from 10 mm to 1 mm, the size of the collected sands or oversized particles increased, while the size of the collected slimes or undersized particles only slightly increased.

Figure 3:
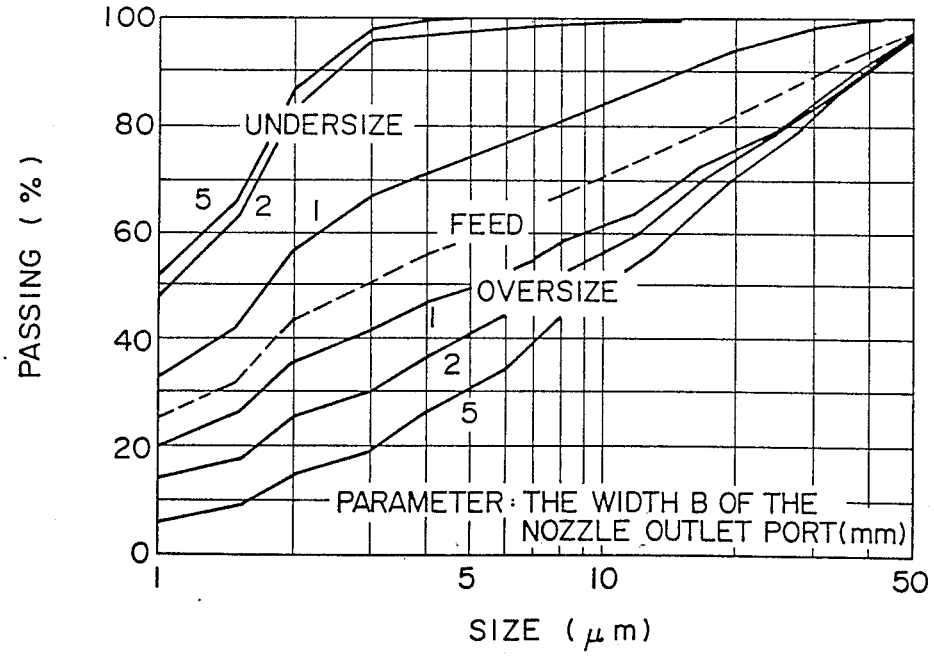

FIG. 3 shows a test result of classification of the apparatus. The classification performance was tested by setting the width B of the nozzle outlet port at 1, 2, and 5 mm with a constant output speed of the feed fluid stream set at 250 m/s. The result obtained with the width B of 5 mm in the test was similar to that of the simulation performance. However, as the width B was narrowed successively to 1 mm, the size of the collected sands decreased while size of the collected slimes increased, resulting in poor classification.

As is known from those results, in case the sands are to be collected by eliminating the slimes from the feed mixture, it is not always effective to decrease the width B of the nozzle outlet port. An increase of the width B for the same purpose requires an increased amount of the fluid (or air in this particular embodiment). The range of the width B is practically 1 to 15 mm, and preferably 2 to 10 mm in view of the classifying performance.

Figure 1A:
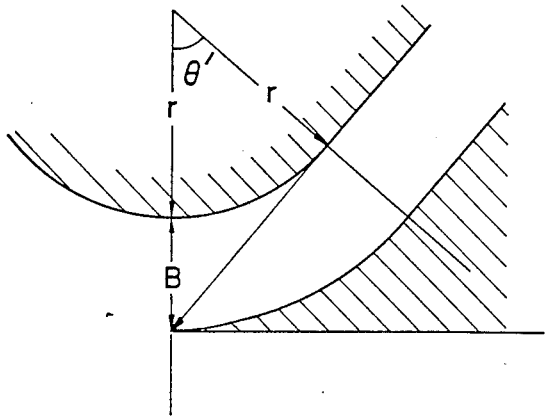
FIG. 1A is a schematic view showing the dimensions of primary parts of the invention.

The length of the curved passage P is determined such that the particles accelerated to move in a linear direction, if any, are prohibited from maintaining their linear motion by inertia even when the particles are about to enter the downstream classifying zone Z. To this end, the length of the curved passage P should be long enough to bend the direction in which the stream of the particles advances. The minimum value of such length is obtained by setting forth a tangential angle $\theta'$ of FIG. 1A. The minimum tangential angle $\theta'$ is represented by $$\cos\ \theta' = \frac{r}{r+B}$$

$$\theta' = \cos^{-1}\left(\frac{r}{r+B}\right).$$

If the length of the curved passage is set forth at greater than this minimum value obtained hereinabove, the particles entrained in the fluid stream flow without rendering a considerable decrease of their flowing speed. For example, if the radius r is 15 mm and the width B is 2 mm, the minimum tangential angle $\theta'$ becomes 28 degrees. Further if the radius r is 500 mm and the width B is 10 mm, the minimum angle $\theta'$ becomes 11 degrees.

Figure 5:
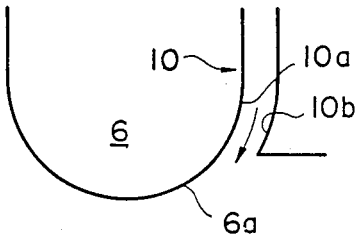
FIGS. 5 and 6 are schematic views of modified nozzle outlet ports of the classifier.
Figure 6:
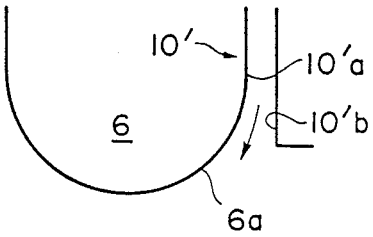

The apparatus may have an outlet port 10 having a pair of inner and outer arcuate walls 10*a*, 10*b* defining therebetween a curved passage or preliminary classifying zone of a relatively small length as shown in FIG. 5. The outer wall of the preliminary classifying zone may be a flat wall 10'*a* as shown in FIG. 6.

Figure 7:
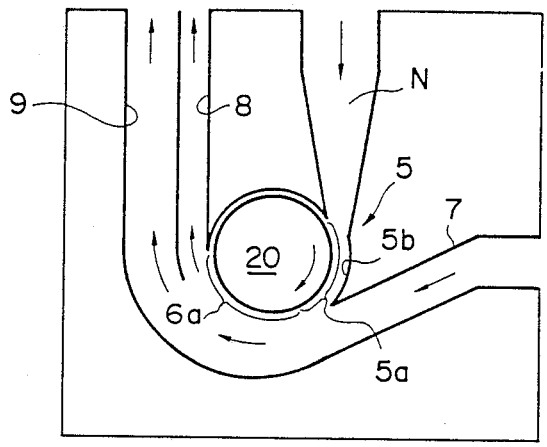
FIG. 7 is a schematic view showing a modification of a cyclonic wall of the classifier.
Figure 8:
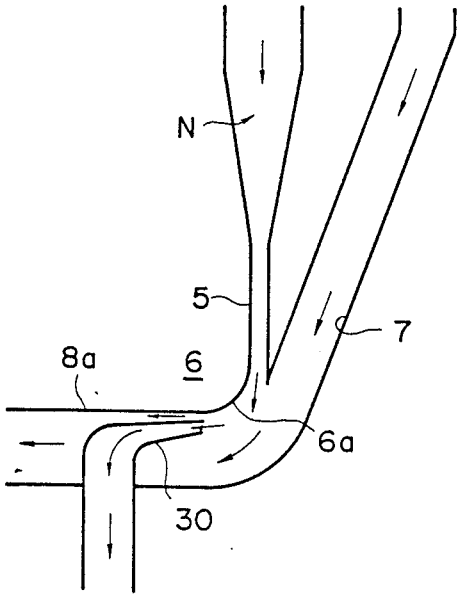
FIG. 8 is a schematic cross-sectional view of the classifier according to a second embodiment of the invention.
Figure 9:
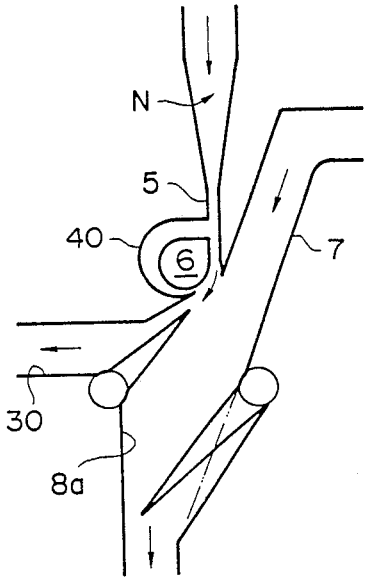
FIGS. 9 and 10 are schematic cross-sectional views showing various modifications of the classifiers according to the second embodiment.
Figure 10:
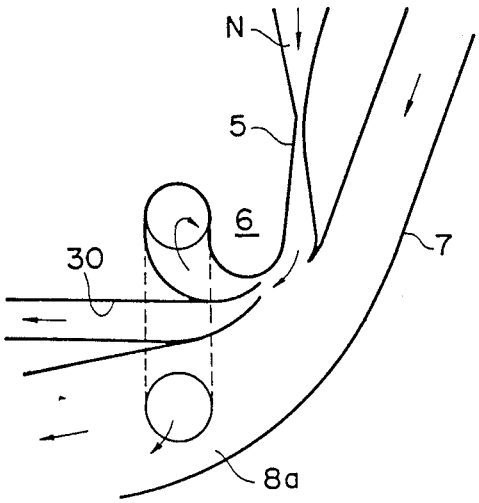

FIG. 7 shows another modification of the first embodiment of the invention, in which the arcuate inner wall 6*a* and the first arcuate side wall 5*a* are peripheral wall portions of a rotatable cylindrical wheel 20, and the second arcuate side wall 5*b* is disposed concentrically with the rotatable cylindrical wheel 20. The rotatable wheel 20 rotates rapidly in the same direction of the feed mixture stream (clockwise in FIG. 7) to thereby provide a continuously forwarding wall surface immediately downstream of the feed nozzle N such that the rotating cylindrical wall (i.e. the inner walls 5*a* and 6*a*) imparts a forward pull to the feed mixture stream adjacent to the same and thus accelerate the stream. The accelerated feed mixture stream permits the particles flowing close to the inner wall surfaces 5*a* and 6*a* to undergo an increased degree of centrifugal force. With this arrangement, the sands remaining in the stream flowing aside the inner wall 6a in the classifying zone are deflected away from the inner wall 6a, with the result that the particles finally collected at the inner exhaust port 8 include very few or no oversized particles. FIGS. 8 to 10 show various modifications of a classifier according to a second aspect of the present invention.

The apparatus has a similar function as the above-described embodiment and includes a feed nozzle N for supplying a jet stream of a solid-gas feed mixture fluid, a cyclonic block 6 disposed downstream of the nozzle and having an arcuate inner wall 6a defining a classifying zone Z for classifying the particles by size, a control port 7 which tangentially merges with the classifying zone Z for supplying a supplemental jet stream of fluid, and an exhaust port 8a disposed downstream of the classifying zone Z for conducting the particles classified in the zone Z to endmost collector chambers (not shown).

The apparatus further includes a collecting port 30 disposed adjacent to the inner arcuate wall 6a. The collecting port 30 is spaced by a predetermined distance K away from the inner arcuate block 6a of the cyclonic wall 6 to collect the slimes exclusively.

Figure 13:
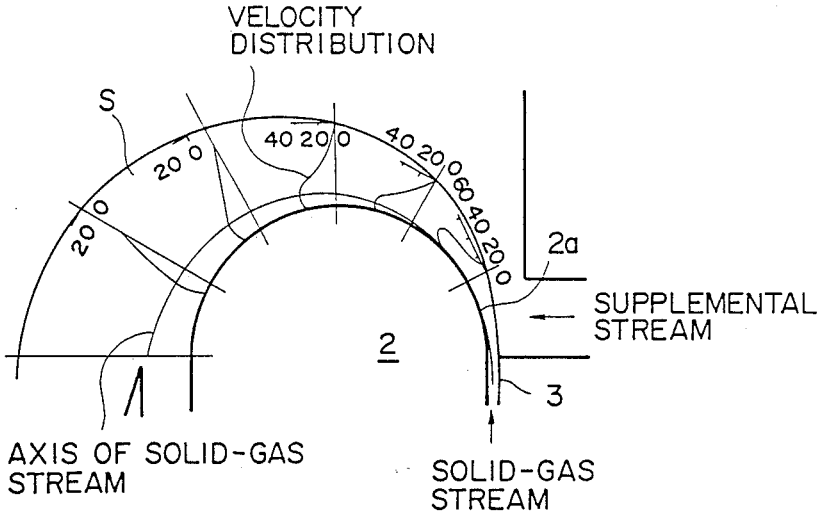
FIG. 13 is a schematic view showing locational speed variations of the wall-attachment stream in a prior classifier.

As described with reference to FIG. 13, the wall-attachment stream of the feed mixture is formed within a wall-attachment zone S extending along the inner wall 2a. Adjacent to the wall-attachment zone, there exists an outer boundary zone where turbulence of the stream takes place, and thus the velocity of the stream is drastically reduced to zero. The above-mentioned predetermined distance K corresponding to the width of the wall-attachment zone S i.e., to the distance between the inner wall surface 2a and the outer boundary.

Figure 12A:
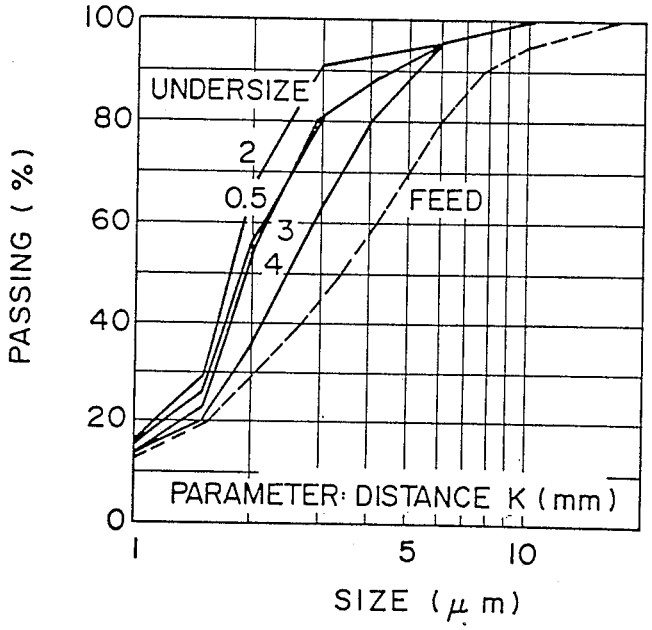
FIGS. 12A and 12B are charts showing the test results of the recovery of the particles obtained by varying the location of the collecting port.
Figure 12B:
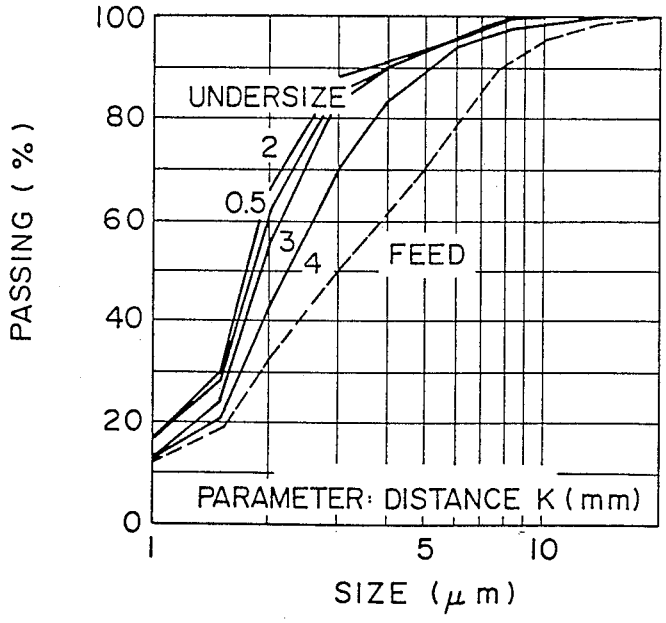

FIGS. 12A and 12B are charts showing recovery performance obtained in Tests A and B. As is known from the results of the two similar tests, the distance K is most preferably within the range 0.5–3 mm, where undersized particles on the order of 2 μm were collected at a recovery rate of more than 50%.

In FIG. 8, the wall-attachment stream flowing along the inner wall surface 6a is subject to the centrifugal force effectively while being accelerated and retained within the wall-attachment zone by the supplemental stream from the control port 7. The particles in the wall-attachment stream of the solid-gas are thus laterally displaced in an orderly manner according to their size such that the smaller they are in size, the closer they are to the inner wall, while the larger they are in size, the more remote they are from the inner wall. The collecting port 30 catches particles to bring thereinto a portion of the solid-gas stream entraining the undersized particles (fine particles) substantially exclusive of the oversized particles.

In the outer boundary zone or turbulent stream zone, however, the solid-gas stream flows at a relatively low speed and thus undergoes the centrifugal force only insufficiently. Therefore the particles in this stream which remain and are not yet substantially separated into the undersized and oversized particles in the outer boundary zone are brought to the exhaust port 8a.

Figure 11:
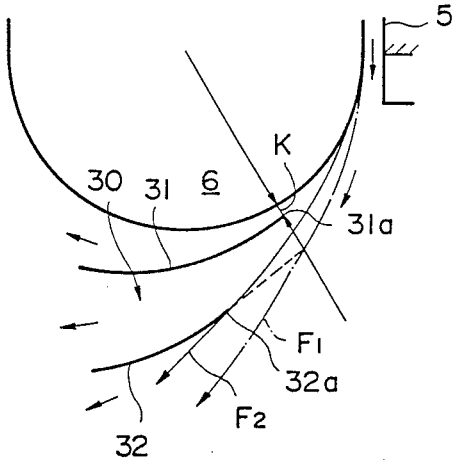
FIG. 11 is an enlarged schematic view showing an inlet opening of a collecting port.

FIGS. 9 to 11 show various modifications of the second embodiment.

A classifier of FIG. 9 has a bypass channel 40 having an inlet open at the inner wall 6a of the cyclonic block 6 and an outlet open to the outlet port 5 of the feed nozzle N. The bypass channel 40 collects a portion of the wall-attachment stream and hence the undersized particles, and then brings the latter back to the outlet port 5 of the nozzle N. This bypass system further improves the recovery rate of the undersized particles by the collecting port 30.

A classifier of FIG. 10 has a Laval nozzle 5' forming the nozzle outlet port. The Laval nozzle is able to supply a jet stream of the high velocity (up to 500 m/s) while the nozzle N described hereinabove supplies a jet stream of a velocity up to the speed of sound (i.e., approximately 340 m/s). An increase of the velocity of the wall-attachment stream permits the centrifugal force to act on the particles more effectively.

FIG. 11 shows a modification of the collecting port 9. The collecting port has a pair of inner and outer side walls 31, 32 which defines an inlet opening therebetween such that a forward or upstream end 32a of the outer side wall 32 is retarded rearwardly and disposed downstream of a forward or upstream end 31a of the inner wall 31. This arrangement enables the collecting port 30 to collect the undersized particles, exclusively since a particle having a certain amount of mass takes the course indicated by a phantom line F1, while a particle having a smaller amount of mass takes the course indicated by a solid line F2.

The location of the inlet opening of the collecting port with respect to the cyclonic block 6 should be selected according to the classifying conditions of the particles. If the particles of the size of smaller than 10 μm for instance, are to be collected, it may be preferable that the tangential angle $\theta$ (FIG. 1) is 30 to 180 degrees and the inner forward end 31a is spaced by the distance up to 2 mm away from the inner arcuate wall 6a of the cyclonic wall 6.

The width, the length, and the radius of curvature of the nozzle outlet port 5 may be determined according to factors concerned with the formation of the wall-attachment stream.

An increase in the distance between the inlet opening of the collecting port 9 and the inner arcuate wall 6a will enable the collecting of the oversized particles instead of the undersized particles. Alternatively, a plurality of the collecting ports 9 may be provided such that they are disposed progressively away from the inner wall 6a to collect the particles of different sizes.

With the arrangement of the present invention, the particles entrained in the solid-gas stream, particularly the wall-attachment stream, are separated by size with an increased reliability.

Obviously, numerous modifications and variations of the present invention are possible in light of the above teachings. It is therefore to be understood that within the scope of the appended claims, the invention may be practiced otherwise than as specifically described herein.

What is claimed is:

1. An apparatus for classifying particles, said apparatus comprising:

(a) a feed nozzle having an outlet port defined by a first side wall and a second side wall spaced from and at least approximately equidistant from said first side wall for producing a first jet stream of particles entrained in a gas;

(b) a cyclonic block disposed downstream of and continuous to said first side wall of said feed nozzle, said cyclonic block having a first inner arcuate surface sized, shaped, and positioned such that, in use, the first jet stream flows therealong;

(c) a control port sized, shaped, the positioned to produced a second jet stream of a gas that merges tangentially with the first jet stream adjacent said cyclonic block but on the side thereof remote from said cyclonic block to accelerate the first jet stream, said control port being defined by a first straight, imperforate side wall the merges tangentially with said second side wall and a second straight, imperforate side wall that is spaced from and at least approximately parallel to said first straight, imperforate side wall; and (d) at least two collecting ports disposed downstream of said cyclonic block in position to receive portions of the merged first and second jet streams, wherein:

(e) said cyclonic block has a second inner arcuate surface sized, shaped, and positioned such that, in use, the first jet stream flows therealong and (f) said second inner arcuate surface is located upstream of said first inner arcuate surface and upstream of said control port.

2. An apparatus as recited in claim 1 wherein one of said at least two collecting ports is located between 0.3 and 3 mm from said first inner arcuate surface of said cyclonic block.

3. An apparatus as recited in claim 1 wherein:

(a) a first one of said at least two collecting ports is defined by said first inner arcuate surface of said cyclonic block and a first wall;

(b) a second one of said at least two collecting ports is defined by said first wall and a second wall; and (c) the upstream end of said first wall is upstream of the upstream end of said second wall.

4. An apparatus as recited in claim 1 wherein said second inner arcuate surface comprises an extension of said first inner arcuate surface.

5. An apparatus as recited in claim 1 wherein said first inner arcuate surface is a rotatable cylindrical surface.

6. An apparatus as recited in claim 1 wherein said outlet port has a width of 1–15 mm.

7. An apparatus as recited in claim 1 wherein said outlet port has a width of 2–10 mm.

8. An apparatus as recited in claim 1 wherein said first and second side walls are both arcuate.

* * * * *